US007621412B2

(12) United States Patent
Raniwala

(10) Patent No.: US 7,621,412 B2
(45) Date of Patent: Nov. 24, 2009

(54) HOT FILL CONTAINER AND CLOSURE AND ASSOCIATED METHOD

(75) Inventor: Subodh K. Raniwala, Mundelein, IL (US)

(73) Assignee: Stokely-Van Camp, Inc., Indianapolis, IN (US)

( * ) Notice: Subject to any disclaimer, the term of this patent is extended or adjusted under 35 U.S.C. 154(b) by 247 days.

(21) Appl. No.: 10/606,439

(22) Filed: Jun. 26, 2003

(65) Prior Publication Data

US 2004/0265447 A1 Dec. 30, 2004

(51) Int. Cl.
*B65D 51/16* (2006.01)
*B65D 51/18* (2006.01)
*B65D 53/06* (2006.01)

(52) U.S. Cl. ..... 215/261; 215/308; 215/341; 220/256.1; 220/361; 220/364; 220/373; 220/303

(58) Field of Classification Search ..... 426/112, 426/115, 392, 395–397, 399, 118, 113, 107, 426/234; 215/261, 307, 308, 310, 341, 347, 215/348, 260, 262, 270, 271; 220/256.1, 220/361, 371, 373, 661, 601, 676, 364
See application file for complete search history.

(56) References Cited

U.S. PATENT DOCUMENTS 1,925,443 A * 9/1933 Gere ..... 426/118
2,424,801 A 7/1947 Crabbe et al.
2,492,883 A * 12/1949 O'Neil ..... 220/364
2,884,152 A 4/1959 Barclay
2,997,397 A * 8/1961 Doulgheridis ..... 426/402
3,045,854 A 7/1962 Patton
3,059,800 A 10/1962 Mills
3,071,276 A 1/1963 Pellett et al.
3,083,861 A * 4/1963 Amberg et al. ..... 220/371
3,114,467 A 12/1963 Montgomery
3,326,401 A 6/1967 De Long
3,448,882 A 6/1969 Roy
3,471,051 A 10/1969 Cistone
3,521,784 A 7/1970 Gaines et al.
3,696,958 A 10/1972 Lee
3,951,293 A 4/1976 Schulz
4,089,434 A 5/1978 Tagalakis et al.
4,121,728 A 10/1978 Tagalakis et al.
4,136,796 A 1/1979 Dubois et al.

(Continued)

OTHER PUBLICATIONS

Print out of Performance Systematix, Inc. website (psix.com) description of Circumvent and Airfoil vented liner systems.

*Primary Examiner*—Anthony D Stashick
*Assistant Examiner*—Niki M Eloshway
(74) *Attorney, Agent, or Firm*—Banner & Witcoff Ltd.

(57) ABSTRACT

A method for hot-filling and closing a polymer container is disclosed in which one of the closure for the container and the head space area of the container is provided with a hole covered with a hydrophobic air permeable membrane. The container is then filled with a hot liquid and the filled container is closed but for the air permeable component. The filled container is then cooled with the pressure between the interior of the container and the ambient pressure being equalized due to the air permeable membrane. Subsequent to cooling, an air-tight seal is provided over the membrane-covered hole. An associated container and closure cap is also disclosed.

20 Claims, 1 Drawing Sheet

U.S. PATENT DOCUMENTS 4,174,784 A * 11/1979 Hartung ..... 215/349
4,299,921 A 11/1981 Youssef
4,363,420 A * 12/1982 Andrews ..... 220/787
4,478,788 A * 10/1984 Rozmus et al. ..... 419/48
4,648,519 A 3/1987 Kennedy
4,765,499 A 8/1988 von Reis et al.
4,863,051 A 9/1989 Eibner et al.
4,865,207 A 9/1989 Joyner et al.
5,117,999 A 6/1992 Canzano et al.
5,176,271 A 1/1993 Painchaud et al.
5,180,073 A 1/1993 Fay et al.
5,358,872 A * 10/1994 Mussi et al. ..... 435/297.1
5,460,282 A * 10/1995 Giblin et al. ..... 215/260
5,522,155 A * 6/1996 Jones ..... 34/286
5,522,769 A 6/1996 DeGuiseppi
5,579,936 A 12/1996 Costa et al.
5,596,814 A 1/1997 Zingle et al.
5,622,865 A * 4/1997 Kayal et al. ..... 435/304.1
5,730,306 A 3/1998 Costa et al.
5,732,837 A 3/1998 Jones
5,759,668 A * 6/1998 Ishikawa et al. ..... 428/137
5,853,096 A * 12/1998 Bartur et al. ..... 215/261
5,901,867 A * 5/1999 Mattson ..... 215/261
5,916,671 A 6/1999 Dauber et al.
5,971,184 A 10/1999 Krishnakumar et al.
5,988,414 A 11/1999 Schwarz et al.
5,988,426 A 11/1999 Stern
5,988,448 A * 11/1999 Foth ..... 222/189.09
6,196,409 B1 * 3/2001 Lake et al. ..... 220/371
6,274,209 B1 8/2001 Pagidas et al.
6,398,048 B1 6/2002 Kevorkian
6,416,831 B1 * 7/2002 Hara et al. ..... 428/34.6
6,474,515 B1 11/2002 Ladina et al.
6,484,895 B2 11/2002 Montgomery et al.
6,548,134 B1 * 4/2003 Rogers ..... 428/35.7
6,602,309 B2 8/2003 Vizulis et al.
6,983,857 B2 1/2006 Miller et al.
2002/0056695 A1 5/2002 Boulange et al.
2002/0157971 A1 10/2002 Carlson

* cited by examiner

HOT FILL CONTAINER AND CLOSURE AND ASSOCIATED METHOD

BACKGROUND OF THE INVENTION

The present invention relates to a method for hot filling containers and, more particularly, to a hot-filling method and an associated container or closure.

In order to maintain product quality and consumer safety, most foodstuffs are packaged in a hot-fill operation in which the foodstuffs are placed in the containers while hot. During filling, the container subjected to elevated temperatures (i e., the product temperature, which is typically on the order of 82° C., or higher), sealed, and then cooled.

Hot-filling is commonly used in the bottling of beverages, such as fresh or frozen drinks, fruit juices, isotonic (sports) beverages, etc. These products are typically packaged in PET bottles, which are light, tough, and well suited to the lifestyles of today's consumers.

The design of PET bottles for use in hot-fill operations is not a simple matter. At elevated temperatures, PET softens and loses its shape. The bottles are subjected to hydrostatic pressure exerted on the sidewalls of the container by the weight of the hot liquid, causing the sidewalls to bulge outwardly. During capping, further swelling of the container occurs as the air in head space expands. Finally, as the bottle cools, the volume of the contents, both liquid and air, contracts, causing the bottle sidewalls to collapse inwardly.

To prevent excessive or uncontrolled distortion of the container upon cooling, hot-fill containers are commonly formed with vacuum panels in the middle portion of the sidewalls. As a container is cooled, the vacuum panels move inwardly to accommodate the vacuum formed in the interior of the container.

The need for vacuum panels complicates meeting other packaging requirements, such as providing the mid-section of the bottled with consumer information, promotional graphics, and a grippable profile. Vented container closures incorporating hydrophobic membranes (i.e., membranes that allow air but not liquid to pass therethrough) are known. Their use would relieve the negative internal pressure experienced during container cooling and still seal the container against leakage. However, because such vented caps also permit gaseous fluids to migrate into the heads space of the bottle, both the quality (e.g. the taste profile) and the safety of the contents could potentially be compromised.

Accordingly, it is an object of the present invention to provide a method for hot-filling PET containers that provides for venting during cooling and an air tight seal thereafter.

It is a related object to provide a PET container and/or closure that can be used in the method.

SUMMARY OF THE INVENTION

These objects, as well as others that will become apparent upon reference to the following Detailed Description and accompanying drawings, are achieved by a method for hot-filling and capping a polymer container in which either the closure for the container or the head space area of the container is provided with a hole covered with a hydrophobic air permeable membrane. The container is then filled with a hot liquid and the cap is applied to the filled container. The filled container is then cooled with the pressure between the interior of the container and the ambient pressure being equalized due to the flow of air across the air permeable membrane. Subsequent to cooling, an air-tight seal is provided over the membrane-covered hole. An associated container and/or closure cap that is used in the method is also disclosed.

DETAILED DESCRIPTION

Figure 1:
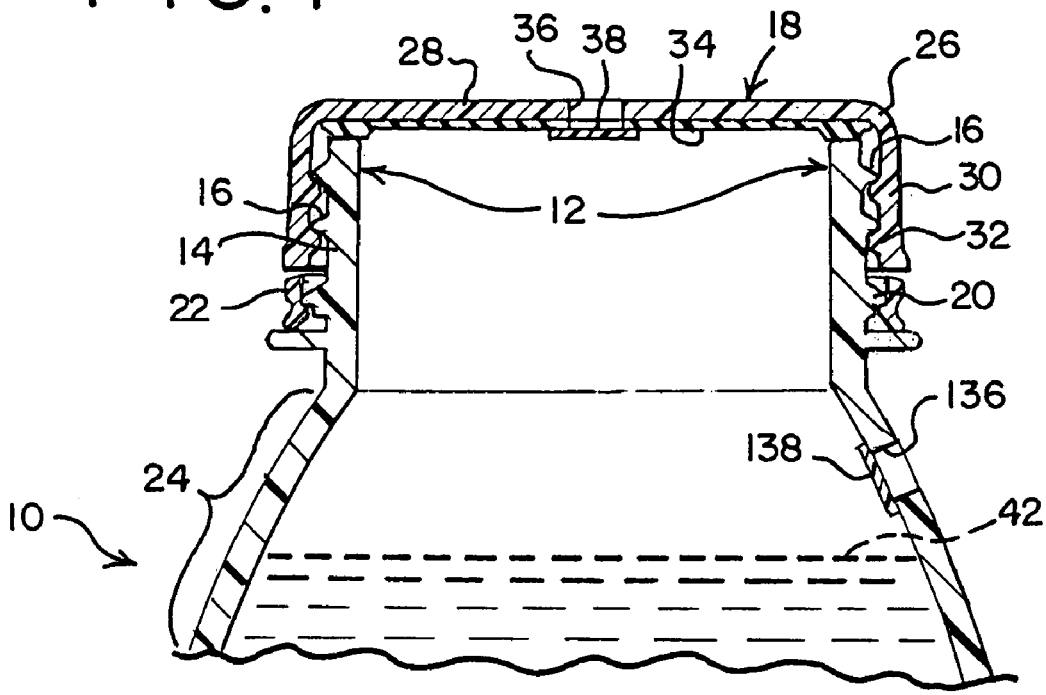
FIG. 1 is a partial fragmentary view of a vented container/closure in accordance with the present invention.
Figure 2:
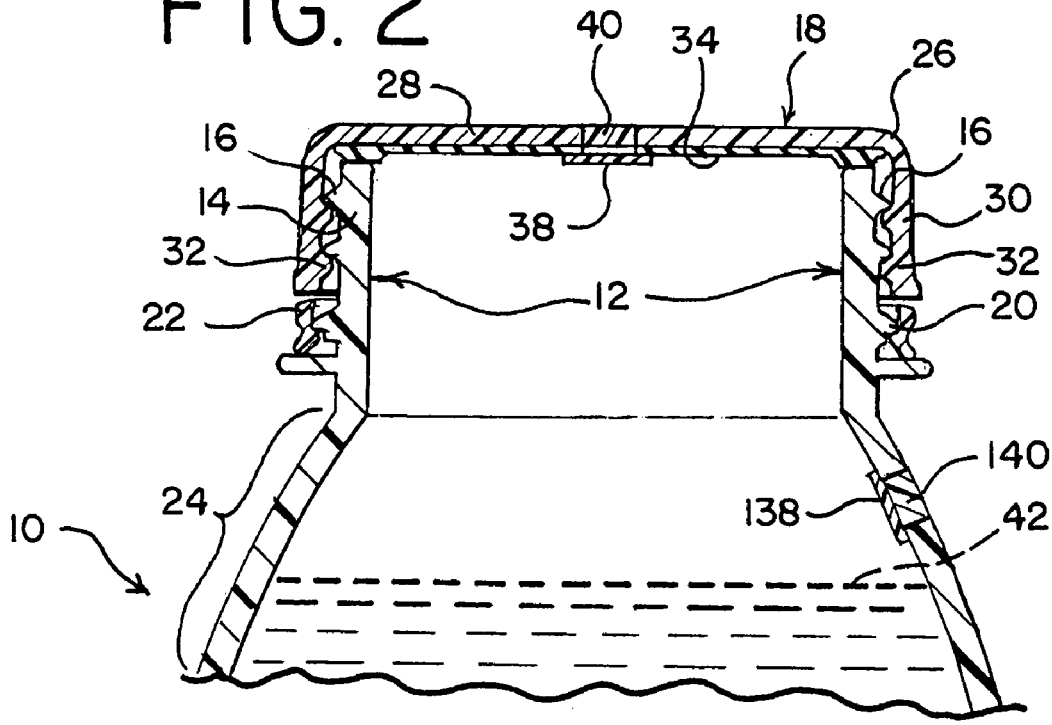
FIG. 2 is a partial fragmentary view of a vented container/closure in accordance with the present invention with the vent being sealed.

Turning to the drawings, there is seen a container 10 (in partial fragmentary view) and its associated closure 18 in accordance with the present invention. Specifically, in FIG. 1, the shoulder and neck portion of a vented polymeric bottle or container and closure cap is shown with vent being open, while in FIG. 2, the vent is sealed.

The container 10 includes, starting at the top, an open mouth 12 defined by a neck finish 14. The neck finish 14 of this embodiment includes external threads 16 for receiving the screw-on closure cap 18 and a rib 20 for retaining a tamper-evident ring 22 that is frangibly attached to the closure cap 18.

Beneath the neck finish 14, the container 10 includes a shoulder portion 24 that generally increases in diameter from the neck finish 14 to the container mid-section (not shown), which can be of a generally cylindrical configuration. The container mid-section, in turn, terminates in the container base (also not shown).

As is well-known, the container 10 is typically blow molded from an injection-molded preform that may be made from various polymer resins, such as polyesters, polyolefins, polycarbonates, nitrites and copolymers thereof. Bi-axially oriented polyethylene terephthalate (PET) is commonly used.

The closure cap 18 typically comprises a polymer shell 26 with a top surface 28 with a skirt 30 depending therefrom. Examples of suitable polymers include polypropylene or polyethylene polymer. The skirt includes internal threads 32 for mating with the external threads 16, provided on the neck finish 14. The underside of the top surface 28 of the closure cap 18 may optionally include a liner 34 made of a resilient material for sealing the interfacing surfaces of the closure cap 18 and the container lip. Alternatively, the closure cap 18 may be linerless.

In order to permit the equalization of pressure between the container interior and the ambient atmosphere during cooling of the container after hot filling, the closure cap is provided with a through-hole 36 in its top surface and associated liner 34. Alternatively, the hole 36 can be located in the skirt portion 36 or the cap 18. The hole 36 has a diameter on the order of 50 microns to 100 microns. The through-hole 36 is covered on its interior side with a membrane 38 made of a hydrophobic, air permeable material, such as expanded polytetraflouro-ethylene (ePTFE) or polypropylene, that serves as a vent. The vent membrane 38 has a porosity of between about 20 percent and 40 percent, and preferably 30 percent, with an average pore size of from about 0.3 to 5.0 microns. Preferably, the pore size is from about 0.4 to 2.0 microns, and, more preferably from about 0.5 to 1.5 microns. In practice, an average pore size of about 1.0 micron has been found to provide satisfactory results.

In keeping with the invention, the vent membrane 38 is provided with a seal 40 after the contents of the bottle has been cooled to ambient temperature. The seal 40 prevents any further ingress or egress of gaseous fluids with respect to the interior of the container 10. The seal 40 can be any food grade material that forms both an oxygen and moisture barrier, and may be in the form of a coating, such as a UV activatable material, a composition which solidified upon exposure to actinic radiation, paint, or semi-transparent adhesive that the seal 40 fills the hole 36 resulting in the seal 40 being flush with the top surface 28 of the closure cap 18. Alternatively, the seal 40 may comprise an air-tight plastic membrane with a pressure-sensitive adhesive on one side that is applied over the hole 36 on the outside of the top surface 28 on the closure cap 18.

In an alternative embodiment, the container itself can be provided with the vent, rather than the closure cap. As seen in the drawings, the container 10 may include a through-hole 136 in its shoulder portion above the liquid level or fill line 42 of the container 10. The through-hole 136 is provided with a vent membrane 138 disposed on the interior of the container 10, which is provided with a seal 140 after cooling, all as described above.

Based on the foregoing, the method of the present invention should be self-evident. Either the cap or the shoulder portion of the container above the fill line is provided with a through-hole that is covered with a hydrophobic, air permeable membrane. When the container is filled with a hot liquid and the cap is applied to the filled container. The container is then cooled to ambient temperature. During cooling, air can pass through the membrane to permit equalization between the pressure on the interior of the container and ambient pressure. After cooling, an air-tight seal is applied over the membrane-covered hole, thus preventing any further migration of air across the membrane and resulting in a container having a substantially air-tight, as well as liquid-tight, seal.

Thus, a hot fill method and associated container or closure has been provided that meets the objects of the present invention. As a result, the container no longer requires the deformable vacuum panels in its body portion that are commonly found in hot-fill polymer containers. With the vacuum panels eliminated, the design of the container is greatly simplified and, for example, a functionally grippable profile is more easily provided.

While the invention has been described in terms of certain preferred embodiments, there is no intent to limit the invention to the same. Indeed, while the invention is shown in connection with a polymer bottle, the vent membrane and seal may also be used on other types of aseptic, hot-fill containers, such as pouches and boxes. Consequently, the invention is defined by the scope of the following claims.

What is claimed:

1. A container comprising:

a container body;

a closure capping the body, at least one of the closure and body having a through-going hole opening at inner and outer ends thereof into respective inner and outer surfaces of the at least one of the closure and body;

a hydrophobic air permeable membrane secured to the inner surface and closing the inner end of the hole; and an air tight seal permanently bonded to the at least one of the closure and body, permanently closing the outer end of the hole, the seal comprising a dryable coating that completely covers the hole to close the outer end of the hole.

2. The container of claim 1 wherein the air tight seal extends from the air permeable membrane within the hole and terminates flush with the outer surface of the at least one of the closure and body.

3. The container of claim 1 wherein hydrophobic air permeable membrane comprises polypropylene or expanded polytetraflouro-ethylene.

4. The container of claim 1 wherein the membrane has pores sized from about 0.3 to 5 microns.

5. The container of claim 1 wherein the membrane has pores sized from about 0.4 to 2 microns.

6. The container of claim 1 wherein the membrane has pores sized from about 0.5 to 1.5 microns.

7. The container of claim 1 wherein the membrane has pores having an average of about 1.0 micron.

8. The container of claim 1 wherein the hole is sized between about 50 and 100 microns.

9. The container of claim 1 wherein the dryable coating comprises a UV activated sealant.

10. The container of claim 1 wherein the dryable coating comprises a paint.

11. The container of claim 1, wherein the air tight seal extends atop the outer surface of the at least one of the closure and body and covers the outer end of the hole.

12. The container of claim 1, wherein the hole extends through the body and is spaced from the closure, the air tight seal being supported by the air permeable membrane and extending therefrom within the hole so as to terminate flush with the outer surface of the body.

13. A container comprising:

a body having an open mouth and a through-going hole opening at inner and outer ends thereof into respective inner and outer surfaces of the body;

a closure capping the open mouth, wherein the hole is spaced from the closure;

a hydrophobic air permeable membrane secured to the inner surface and closing the inner end of the hole; and an air tight seal closing the outer end of the hole, wherein the air tight seal is supported by the air permeable membrane and extends therefrom within the hole so as to terminate flush with the outer surface of the body.

14. A hot-fill container comprising:

a body having an open mouth and a through-going hole opening at inner and outer ends thereof into respective inner and outer surfaces of the body;

a closure capping the body;

a hydrophobic air permeable membrane secured to the inner surface and closing the inner end of the hole; and an air-impermeable sealing material irremovably contained within the hole to provide an air-tight seal over the air permeable membrane, wherein the sealing material is supported by the air permeable membrane and extends therefrom within the hole so as to terminate flush with the outer surface of the body.

15. The container of claim 14, wherein the hole is spaced from the open mouth.

16. A container comprising:

a container body;

a closure capping the body, at least one of the closure and body having a through-going hole opening at inner and outer ends thereof into respective inner and outer surfaces of the at least one of the closure and body;

a hydrophobic air permeable membrane secured to the inner surface and closing the inner end of the hole; and an air tight seal permanently closing the outer end of the hole, wherein the seal comprises a dryable coating comprising a material selected from the group consisting of: a UV activated sealant and a paint.

17. A container comprising:

a container body;

a closure capping the body, at least one of the closure and body having a through-going hole opening at inner and outer ends thereof into respective inner and outer surfaces of the at least one of the closure and body;

a hydrophobic air permeable membrane secured to the inner surface and closing the inner end of the hole; and an air tight seal permanently closing the outer end of the hole, the seal comprising an air tight membrane with a pressure-sensitive adhesive on one surface thereof.

18. A container comprising:

a container body;

a closure capping the body, the body having a through-going hole opening at inner and outer ends thereof into respective inner and outer surfaces of the body, the hole being spaced from the closure;

a hydrophobic air permeable membrane secured to the inner surface and closing the inner end of the hole; and an air tight seal permanently closing the outer end of the hole, the air tight seal being supported by the air permeable membrane and extending therefrom within the hole so as to terminate flush with the outer surface of the body.

19. A container comprising:

a container body:

a closure capping the body, at least one of the closure and body having a through-going hole opening at inner and outer ends thereof into respective inner and outer surfaces of the at least one of the closure and body;

a hydrophobic air permeable membrane secured to the inner surface and closing the inner end of the hole; and an air tight seal permanently bonded to the at least one of the closure and body, permanently closing the outer end of the hole, wherein the seal comprises a semi-transparent adhesive, and wherein the semi-transparent adhesive completely covers the hole to close the outer end of the hole.

20. A container comprising:

a container body;

a closure capping the body, at least one of the closure and body having a through-going hole opening at inner and outer ends thereof into respective inner and outer surfaces of the at least one of the closure and body;

a hydrophobic air permeable membrane secured to the inner surface and closing the inner end of the hole; and an air tight seal permanently bonded to the at least one of the closure and body, permanently closing the outer end of the hole, wherein the seal comprises a composition which solidifies upon exposure to actinic radiation, and wherein the composition completely covers the hole to close the outer end of the hole.

* * * * *

UNITED STATES PATENT AND TRADEMARK OFFICE

CERTIFICATE OF CORRECTION

PATENT NO. : 7,621,412 B2
APPLICATION NO. : 10/606439
DATED : November 24, 2009
INVENTOR(S) : Raniwala It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 365 days.

Signed and Sealed this

Twelfth Day of October, 2010

David J. Kappos

David J. Kappos
*Director of the United States Patent and Trademark Office*